US008851717B2

(12) United States Patent
Verbrugh

(10) Patent No.: US 8,851,717 B2
(45) Date of Patent: Oct. 7, 2014

(54) DIRECTABLE MAGNETIC MOUNT FOR LIGHT EMITTER, A LIGHT SOURCE, A BASE AND AN ILLUMINATION SYSTEM

(75) Inventor: Stefan Marcus Verbrugh, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 156 days.

(21) Appl. No.: 13/203,011

(22) PCT Filed: Feb. 17, 2010

(86) PCT No.: PCT/IB2010/050707

§ 371 (c)(1),
(2), (4) Date: Nov. 14, 2011

(87) PCT Pub. No.: WO2010/097733

PCT Pub. Date: Sep. 2, 2010

(65) Prior Publication Data

US 2012/0075857 A1 Mar. 29, 2012

(30) Foreign Application Priority Data

Feb. 24, 2009 (EP) ..... 09153509

(51) Int. Cl.

| | |
|---|---|
| ***H01R 11/30*** | (2006.01) |
| ***F21V 21/35*** | (2006.01) |
| ***F21V 29/00*** | (2006.01) |
| ***H01R 13/62*** | (2006.01) |
| ***F21S 8/00*** | (2006.01) |
| ***F21S 8/04*** | (2006.01) |
| ***F21V 23/00*** | (2006.01) |
| ***F21S 8/10*** | (2006.01) |
| ***F21V 21/096*** | (2006.01) |
| *H01R 25/14* | (2006.01) |
| *F21V 21/30* | (2006.01) |
| *F21K 99/00* | (2010.01) |
| *F21Y 101/02* | (2006.01) |

(52) U.S. Cl.

CPC ..... *F21V 21/096* (2013.01); *F21V 21/35* (2013.01); *F21V 29/262* (2013.01); *H01R 25/147* (2013.01); *F21V 21/30* (2013.01); *H01R 13/6205* (2013.01); *F21K 9/00* (2013.01); *F21S 8/038* (2013.01); *F21Y 2101/02* (2013.01); *F21S 8/04* (2013.01); *F21V 23/003* (2013.01); *F21V 29/004* (2013.01); *F21V 29/267* (2013.01); *F21S 48/328* (2013.01); *F21S 8/033* (2013.01); *F21V 29/2293* (2013.01)

USPC ..... 362/398; 362/249.01

(58) Field of Classification Search

USPC ..... 362/398, 249.01

See application file for complete search history.

(56) References Cited

U.S. PATENT DOCUMENTS

| | | | | |
|---|---|---|---|---|
| 4,719,549 | A * | 1/1988 | Apel | 362/398 |
| 5,154,509 | A | 10/1992 | Wulfman et al. | |
| 7,137,727 | B2 | 11/2006 | Joseph et al. | |
| 7,348,604 | B2 | 3/2008 | Matheson | |
| 8,187,006 | B2 * | 5/2012 | Rudisill et al. | 439/39 |
| 2009/0154883 | A1 * | 6/2009 | Robb | 385/56 |

FOREIGN PATENT DOCUMENTS

| | | | |
|---|---|---|---|
| DE | 2643780 | A1 | 3/1978 |
| DE | 19628573 | A1 | 1/1998 |
| EP | 1433996 | A2 | 6/2004 |
| FR | 2033490 | A5 | 12/1970 |

* cited by examiner

*Primary Examiner* — Nimeshkumar Patel
*Assistant Examiner* — Christopher Raabe
(74) *Attorney, Agent, or Firm* — Yuliya Mathis

(57) ABSTRACT

The invention relates to a directable magnetic mount (10) for a light emitter (20). The invention also relates to a light source (200), to a base (40) and to an illumination system (100). The directable magnetic mount comprises interface means (30) configured for conducting thermal energy away from the light emitter to a heat sink (40), and comprises a magnetic connector (50) configured for magnetically connecting the directable magnetic mount to the base. The magnetic connector is configured for thermally interconnecting the interface means and the heat sink. The interface means is configured for being thermally connected to the heat sink at a plurality of orientations of the interface means with respect to the heat sink. Each of the plurality of orientations of the interface means comprises a different emission direction of the light emitter.

The effect of the measures according to the invention is that it enables to omit the need for a heat sink in the light source which enables to reduce the size of the light source while also allowing to reposition and redirect the light emitted from the illumination system.

15 Claims, 6 Drawing Sheets

DIRECTABLE MAGNETIC MOUNT FOR LIGHT EMITTER, A LIGHT SOURCE, A BASE AND AN ILLUMINATION SYSTEM

FIELD OF THE INVENTION

The invention relates to a directable magnetic mount for a light emitter.

The invention also relates to a light source, a base and an illumination system comprising a light source and the base.

BACKGROUND OF THE INVENTION

Light emitters are known per se and are used in every realm of daily life. They are, inter alia, used in general illumination systems, for example, for illuminating indoor and/or outdoor environments, homes, shops, factories and offices, but also, for example, in vehicles of any kind. Also in different application areas, such as in image projection systems, light emitters are often used. Beamers, projection televisions and liquid crystal display devices all have some kind of light source to illuminate the image generated by the device.

Due to this broad span of application areas in which light emitters are used, many different light emitters exist. Incandescent light sources and high and low pressure gas discharge lamps, compact fluorescent lamps, halogen lamps together with the relatively novel semiconducting light emitters such as light emitting diodes and organic light emitting diodes. A common drawback of all of these light emitters is that they produce heat which in general is not wanted.

In recent years semiconducting light emitters have become more and more popular due to the relatively small dimensions of the light emitters in combination with a relatively high light emission intensity. Furthermore, the efficiency and the operational life-time of the semiconducting light emitters are substantially higher compared to any of the other light emitters, which is preferred for environmental and cost reasons. However, the light output that can be generated by the light emitting diode is directly related to the amount of cooling of the light emitting diode. For high-power applications, cooling is obtained via a heat sink comprising cooling fins along which air flows for cooling the high-power light emitting diodes. So, although the semiconducting light emitters have relatively small dimensions, the use of elaborate cooling arrangements may generate a relatively bulky light source, which is not preferred.

In addition, for many applications, a flexible illumination system is required in which the light source or light sources may be moved to different locations within a room relatively easily. For this reason, tracks or rail systems comprising a light source or a plurality of light sources have been applied in which the light source(s) may be positioned at will at any location along the track or rail. Such a system is, for example, introduced to the market by a company known as "Lightolier®" (see their web site www.lightolier.com). Especially their "LED Magnetic Track Undercabinet Fixture" provides a plurality of LED light sources magnetically attached to a track to allow easy repositioning of the LED light sources along the track. Although the LED light sources may be relatively easily repositioned, the light sources cannot be directed and still are relatively bulky due to the cooling fins required.

Thus, a disadvantage of the known illumination system is that the light sources still are relatively bulky and that the direction of light emission cannot be altered.

SUMMARY OF THE INVENTION

It is an object of the invention to provide an illumination system in which the light emission characteristic of the light emitter is changeable and in which the light emitter is relatively small while still allowing sufficient cooling.

According to a first aspect of the invention, the object is achieved by means of a directable magnetic mount for a light emitter. According to a second aspect of the invention, the object is achieved by means of a light source. According to a third aspect of the invention, the object is achieved by means of a base. According to a fourth aspect of the invention, the object is achieved by means of an illumination system.

The directable magnetic mount according to the first aspect of the invention, comprises:

interface means configured for conducting thermal energy away from the light emitter to a heat sink, and a magnetic connector configured for magnetically connecting the directable magnetic mount to a base comprising the heat sink, the magnetic connector being configured for thermally interconnecting the interface means and the heat sink, the interface means being configured for being thermally connected to the heat sink in a plurality of orientations of the interface means with respect to the heat sink.

The base may, for example, be a rail or track which comprises magnetically susceptible material for enabling a magnetic connection via the magnetic connector of the directable magnetic mount. The magnetically susceptible material may be at predefined locations at the base to only allow the connection of the directable magnetic mount at these predefined locations. Alternatively, the base may be constituted of magnetically susceptible material such that the directable magnetic mount may be connected via the magnetic connector at any required location on the base.

The effect of the directable magnetic mount for a light emitter according to the invention is that the interface means is arranged to be in thermal contact with the heat sink of the base, while the interface means is allowed to have a plurality of orientations with respect to the heat sink—and thus to have a plurality of orientations with respect to the base. Due to this arrangement, the emission characteristic of the light emitted by the light emitter may be changed by a user. By virtue of the plurality of orientations, the direction in which the light emitter points may be altered at will, for example, enabling the emission direction to be changed at will within the plurality of orientations of the interface means with respect to the heat sink. The use of the magnetic connector enables the directable magnetic mount to be positioned at a plurality of locations along or at the base in a fashion similar to that possible with the known "LED Magnetic Track Undercabinet Fixture". However, in addition to the repositioning along a rail, also the orientation of the directable magnetic mount according to the invention can be altered at each position while maintaining thermal contact with the heat sink, thus changing the direction in which the light emitter emits its light. The base may, for example, be a rail which typically is relatively large and may, for example, be applied to a ceiling or to a wall. Due to the relatively large size of the base, the heat sink of the base has sufficient heat capacity to efficiently cool the light emitter. The arrangement of the interface means of the directable magnetic mount is chosen to be thermally connected to the heat sink via pressure applied by the magnetic connector interconnecting the interface means and the heat sink. Furthermore, the interface means and the heat sink are configured such that in each of the plurality of orientations of the interface means the heat generated by the light emitter is conducted away from the light emitter via the interface means to the heat sink. Therefore, no local cooling fins are required at the directable magnetic mount, allowing the dimensions of the directable magnetic mount to be relatively small—only marginally larger than the combined dimensions required for the light emitter and, if applicable, an electronic circuit. The plurality of orientations together with the magnetic connector allows a flexible positioning and redirection of the light emitter to, for example, illuminate a specific object in the neighborhood of the base.

The directable magnetic mount according to the invention does not require cooling elements. The interface means transfers the heat from the light emitter to the heat sink at the base. The dimensions of the base and of the heat sink must be chosen such that the heat sink is sufficiently large to cool the light emitter at the directable magnetic mount. The base may also be configured to allow a plurality of directable magnetic mounts to be connected to the base and/or each directable magnetic mount may comprise more than one light emitter. In such arrangements, the dimensions of the base and the heat sink must be chosen such that the heat generated by the plurality of directable magnetic mounts and/or plurality of light emitters can be cooled. By separating the directable magnetic mount from the heat sink, the directable magnetic mount can be made small, as only the light emitter must be accommodated on the directable magnetic mount and the interface means must be able to conduct the thermal energy produced by the light emitter efficiently away from the light emitter towards the heat sink. A further benefit of this arrangement is that it allows broad design freedom to designers of light sources and illumination systems.

A further benefit of the directable magnetic mount according to the invention with respect to the known "LED Magnetic Track Undercabinet Fixture" is that the known "LED Magnetic Track Undercabinet Fixture"-system comprises fins which require air to flow past them to cool the light emitter. This flow of air, especially when the individual light sources are applied on a track applied to a ceiling or wall, may cause local discoloring of the ceiling or wall due to dust and dirt transported by the additional flow of air. When altering the position of the light source along the track, these local discolorings may be very well visible. In the directable magnetic mount according to the invention, no additional flow of air is required locally. The heat sink absorbs the thermal energy required to maintain a good operational temperature of the light emitter. The air flowing past the heat sink will subsequently reduce the temperature of the heat sink. However, this flow of air is not a local flow of air and therefore, local discoloration of the ceiling or wall is avoided.

The light emitter arranged on the directable magnetic mount may comprise a battery for supplying power to the light emitter. Alternatively, an electric cable may be present which is connected to a power supply and which may be used to provide power to the light emitter. Of course, preferably, electrical supply contacts may be arranged at the base and the directable magnetic mount may comprise electrical connectors which are configured for being connected to the electrical supply contacts to provide power to the light emitter.

In an embodiment of the directable magnetic mount, at least a part of an outer wall of the interface means comprises a first shape configured for being thermally connected to a part of an outer wall of a heat sink having a second shape matching the first shape. A benefit of this embodiment is that using matching shapes between the part of the outer wall of the interface means and the outer wall of the heat sink allows good contact between the heat sink and the interface means, enabling good thermal conduction of heat from the light emitter to the heat sink via the interface means.

In an embodiment of the directable magnetic mount, the plurality of orientations of the interface means generate different emission characteristics of light emitted from the directable magnetic mount. The different emission characteristics comprise an emission direction of the light emitted from the directable magnetic mount. By choosing a different orientation of the interface means, the orientation of the light emitter with respect to the heat sink is altered and hence the direction in which the light emitter connected to the directable magnetic mount emits its light. Using this plurality of orientations, the direction in which the light from the directable magnetic mount is emitted may be altered. The different emission characteristics may also comprise a shape of a bundle of light emitted from the directable magnetic mount. A beam-shaping element may, for example, be connected to the directable magnetic mount or to the base, such that when the orientation of the directable magnetic mount is altered with respect to the heat sink, the shape of the bundle of light emitted by the light emitter may be changed. The different emission characteristics may also comprise a color of the light emitted from the directable magnetic mount. The directable magnetic mount may, for example, comprise a plurality of light emitters being configured for emitting different colors of light. When altering the orientation of the interface means, different electrical connectors may be connected to the base supplying power to a different light emitter or a different set of light emitters, causing the color of the light emitted from the directable magnetic mount to be altered. The different emission characteristics may also comprise an intensity and/or an intensity distribution of the light emitted from the directable magnetic mount. Again the altering of the orientation may cause different electrical connectors to be connected, which may dim or boost the intensity of the light emitted from the directable magnetic mount. Furthermore, the number of light emitters emitting light from the directable magnetic mount may be changed due to the change of orientation and consequently alter the intensity and/or intensity distribution of the light emitted from the directable magnetic mount. The different emission characteristics may also comprise a change in the number of light emitters emitting light from the directable magnetic mount comprising a plurality of light emitters.

In an embodiment of the directable magnetic mount, the magnetic connector is arranged outside a thermal conductive path of the interface means. The thermal conductive path is the path in the interface means via which a major part, for example 80%, of the conducted heat is conducted to the heat sink. The magnetic connector may comprise a 'permanent' magnet or an electro-magnet. An electro-magnet is not preferred, as the directable magnetic mount would fall to the ground in the event of a power failure if the directable magnetic mount were applied at a base applied to a wall or ceiling. So, the preferred embodiment would be a magnetic connector comprising a 'permanent' magnet. However, the drawback of 'permanent' magnets is that the magnetic properties may be altered when the temperature of the 'permanent' magnet increases and may even fully disappear when the temperature is increased to above a temperature known as the Curie Temperature, which varies for different magnetic materials. Although it is relatively unlikely that the temperature of the interface means comes near the Curie Temperature, still the variation of the temperature over time and the fact that the magnetic connector may be at an increased temperature for quite some time may reduce the magnetic force of the 'permanent' magnet over time. Furthermore, often the directable magnetic mount comprises electrical connectors for providing power to the light emitter. These electrical connectors conduct current and will have a magnetic field of their own, which may influence the magnetic properties of the 'permanent' magnets, making them more susceptible to external magnetic fields at elevated temperatures. So, preferably, the magnetic connector is arranged outside the thermal conductive path to avoid that the temperature of the magnetic connector is increased and that therefore the magnetic property of the 'permanent' magnet is altered. As the magnetic connector also provides the thermal interconnection of the interface means and the heat sink, the reduction of the magnetic force of the magnetic connector may reduce the thermal conductivity between the interface means and the heat sink, endangering good cooling of the light emitter.

In an embodiment of the directable magnetic mount, the magnetic connector is thermally insulated from the interface means. By thermally insulating the magnetic connector, an increase of the temperature will further be avoided, thus ensuring that the 'permanent' magnet maintains its magnetic force, thereby avoiding that the directable magnetic mount may fall off the base and/or avoiding that the thermal conductivity may be reduced such that the cooling of the light emitter may be endangered.

In an embodiment of the directable magnetic mount, the directable magnetic mount further comprises a plurality of electrical connectors configured for being connected, in operation, to electrical supply contacts at the base for providing power and/or control information to the light emitter. As mentioned before, the light emitter may receive power from a number of possible sources. Batteries may be included or a power supply having cables connected to the light emitter. These solutions are far from practical to users. The use of electrical connectors in mounts for attaching light sources to a rail are applied successfully in practice already and allow a simple and elegant manner of providing power to the light emitter. In addition, these electrical connectors may also be used to provide control information for controlling the light emitter. The word "connector" should be interpreted broadly and may just be an isolated part of the mount or the light emitter. To allow electrical contact, the electrical connectors arranged at the directable magnetic mount must be positioned such that they correspond to the arrangement of electrical supply contacts as provided in the base.

In an embodiment of the directable magnetic mount, the electrical connectors are arranged at the interface means, wherein the plurality of electrical connectors comprise more than two electrical connectors, the plurality of electrical connectors being distributed across the interface means for connecting at least two electrical connectors of the plurality of electrical connectors to the electrical supply contacts at the different orientations of the interface means. Especially because the light emitter must be directable, the change of orientation of the interface means with respect to the heat sink requires that a plurality of electrical contacts (more than two) are present at the interface means of the directable magnetic mount to ensure that the electrical contact is remained, also when the orientation of the interface means is altered with respect to the heat sink.

In an embodiment of the directable magnetic mount, the directable magnetic mount further comprises an electronic circuit for adapting the polarity of the electrical connectors of the plurality of electrical connectors connected to match the required polarity of the light source. For production and cost reasons, the number of electrical connectors should be limited. Therefore, when altering the orientation of the directable magnetic mount with respect to the heat sink, the possible change in orientation should be as small as the distance between two subsequent electrical connectors. In such an arrangement, the polarity of the electrical signal provided via the electrical supply contacts at the base is inverted. This should be corrected by the additional electronic circuit present in the directable magnetic mount. Such an additional electronic circuit may be as simple as a bridge rectifier in which the odd-numbered electrical connectors (being the first, third, fifth, . . . etc) in a row of electrical connectors are connected to a first input port and in which the even-numbered electrical connectors (being the second, fourth, sixth, . . . etc) in the row of electrical connectors are connected to a second input port of the bridge rectifier. The output of the bridge rectifier always comprises the right polarity for the light emitter.

In addition to the electronic circuit for adapting the polarity of the electrical connectors, the directable magnetic mount may also comprise feedback electronics including sensors which may switch off the light emitter when the light emitter becomes too hot. These feedback electronics are already known in the art and may also be applied here. As the operational life of the light emitter often depends on the cooling or quality of cooling of the light emitter, a reduction of the cooling or of the quality of cooling may increase the temperature of the light emitter such that the operational life of the light emitter is reduced. In such a case, the light emitter may be switched off via the feedback electronics. The reduction of the cooling may be caused by dirt or dust present between the interface means and the heat sink, substantially reducing the thermal conduction of heat from the light emitter via the interface means to the heat sink.

In an embodiment of the directable magnetic mount, the outer wall of the interface means and the first shape comprise a curved shape and a part of the curved shape, respectively. A benefit of this embodiment is that the curved shape typically allows a relatively large contact surface between the interface means and the heat sink, improving the transfer of heat from the interface means to the heat sink.

In an alternative embodiment, the outer wall of the interface means and the first shape comprise a cylindrical shape and a part of the cylindrical shape, respectively. A benefit of this embodiment is that again the contact area is relatively large. Furthermore, the cylindrical shape is typically symmetric, which allows for the interface means to be rotated around a common axis of the cylindrical shape of the outer wall of the interface means and the outer wall of the heat sink. This rotation may generate a relatively large range of orientations of the interface means with respect to the heat sink, allowing relatively free redirecting of the emission direction.

In an alternative embodiment, the outer wall of the interface means and the first shape comprise a partial spherical shape and a part of the partial spherical shape, respectively. A benefit of this embodiment is that the spherical shape allows a redirection of the light emitter in substantially two dimensions. In the previous embodiment in which a cylindrical shape was used, the redirection of the light emitter is around a central axis. Now, the theoretically possible redirection of the light emitter is around a point. Of course, for practical reasons, the redirection only covers about half a sphere. Furthermore, when the power for the light emitter is provided via electrical connectors in the interface means, the number of electrical connectors determine the number of different directions in which the light emitter may be redirected. Still, the use of the spherical shape considerably increases the directions in which the emission direction of the light emitter may be redirected.

In an alternative embodiment, the outer wall of the interface means and the first shape comprise a polygon and a corner of the polygon, respectively. A benefit of this embodiment is that, although only a limited number of directions may be chosen from to redirect the emission of the light emitter, the directions are well defined due to the polygon shape of the outer wall of the interface means, which simplifies the arrangement of the electrical contacts in the interface means.

In an alternative embodiment, the outer wall of the interface means and the first shape comprise a polygon and a plurality of corners of the polygon, respectively. A benefit of this embodiment is that the number of redirection directions again is limited and well defined, simplifying the arrangement of the electrical contacts. Furthermore, as a result of the first shape being a polygon, an increase of the contact surface between the interface means and the heat sink is obtained, which improves the thermal conductivity of the interface between the interface means and the heat sink.

The light source according to the second aspect of the invention comprises a light emitter thermally connected to the directable magnetic mount.

The base according to the third aspect of the invention comprises a heat sink for conducting thermal energy away from the interface means connected to the light emitter, and magnetically susceptible material distributed in the base for magnetically connecting the directable magnetic mount or the light source to the base and for thermally interconnecting the interface means and the heat sink, with the heat sink being configured for being thermally connected to the interface means in a plurality of orientations of the interface means with respect to the heat sink.

The base is arranged to cooperate with the directable magnetic mount to ensure thermal contact between the interface means of the directable magnetic mount and the heat sink of the base, while allowing the interface means to have a plurality of orientations with respect to the heat sink. Due to this arrangement, the emission direction of the light emitted by the light emitter may be changed by a user at will within the plurality of orientations of the interface means with respect to the heat sink. The use of the magnetic connector at the directable magnetic mount and the presence of magnetically susceptible material at the base enables the directable magnetic mount to be positioned at a plurality of locations along or at the base. For example, at each of the locations, the orientation of the light emitter may be altered, altering the direction in which the light is emitted. The base may, for example, be a rail which typically is relatively large and which may, for example, be applied to a ceiling or to a wall. Due to the relatively large size of the base, the heat sink of the base may be designed to have sufficient heat capacity to efficiently cool the light emitter. The base and interface means are designed such that there is a good thermal connection between the heat sink and the interface means, for example, by matching the shape of the outer wall of the heat sink to the shape of at least a part of the outer wall of the interface means. This good thermal contact is present at different orientations of the interface means, which allows the orientation of the directable magnetic mount to be altered, thus altering the light emission direction of the light emitter. The plurality of orientations together with the magnetic connector allow a flexible positioning and redirection of the light emitter to, for example, illuminate a specific object in the neighborhood of the base.

In an embodiment of the base, the base comprises electrical supply contacts for providing power to the light emitter via at least two of the plurality of electrical connectors of the interface means. As mentioned before, the use of electrical supply contacts in the base constitutes an elegant manner of providing power to the light emitter. To ensure that this power is also provided when the interface means alters the orientation with respect to the base, the interface means may require more than two electrical connectors.

In an embodiment of the base, the base comprises a distribution of magnetically susceptible material for connecting the directable magnetic mount via the magnetic connector at a plurality of locations with respect to the heat sink, while connecting at least two electrical connectors of the plurality of electrical connectors to the electrical supply contacts in the different emission directions of the light emitter. When the interface means may be moved relatively freely with respect to the heat sink while maintaining good thermal contact, it may be difficult for a user to know when the electrical supply connectors of the base are in contact with the electrical connectors of the interface means. For this reason, the distribution of the magnetically susceptible material may be chosen such that the magnetic connection of the directable magnetic mount is only possible at a discrete selected number of locations in which the electrical connectors of the interface means connect with the electrical supply contacts in the base. As such, when the magnetic connection is established, also the electrical connection is ensured.

In an embodiment of the base, the base comprises ducts for cooling fluid. In the base there may be, for example, a cooling pipe through which a cooling fluid flows or which is hollow and through which air is free to move. Such ducts would improve the capacity of the heat sink, which would allow the dimensions of the heat sink to be reduced or the power of the light emitter to be increased.

In an embodiment of the base, a part of an outer wall of the heat sink comprises a second shape configured for being thermally connected to at least a part of an outer wall of the interface means having a first shape matching the second shape, wherein the second shape comprises a curved shape. As mentioned before, the curved shape typically allows a relatively large contact surface between the interface means and the heat sink.

In an alternative embodiment, the outer wall of the heat sink comprises a cylindrical shape. As mentioned before, the cylindrical shape typically allows a relatively large range of orientations of the interface means with respect to the heat sink, allowing relatively free redirecting of the emission direction.

In an alternative embodiment, the outer wall of the heat sink comprises a partial spherical shape. As mentioned before, the spherical shape further increases the directions in which the emission direction of the light emitter may be redirected.

In an alternative embodiment, the outer wall of the heat sink comprises a triangular shape. The triangular shape provides well-defined directions in which the light emitter may be redirected, which simplifies the arrangement of the electrical contacts in the interface means.

In an alternative embodiment, the outer wall of the heat sink comprises a polygon. The polygonal shape provides well-defined directions, while increasing the contact surface between the interface means and the heat sink.

The illumination system according to the fourth aspect of the invention comprises the light source as claimed in claim 9 and comprises the base as claimed in any of the claims 10 to 14.

BRIEF DESCRIPTION OF THE DRAWINGS

These and other aspects of the invention are apparent from and will be elucidated with reference to the embodiments described hereinafter.

In the drawings.

The figures are purely diagrammatic and not drawn to scale. Particularly for clarity, some dimensions are exaggerated strongly. Similar components in the figures are denoted by the same reference numerals as much as possible.

DETAILED DESCRIPTION OF EMBODIMENTS

Figure 1:
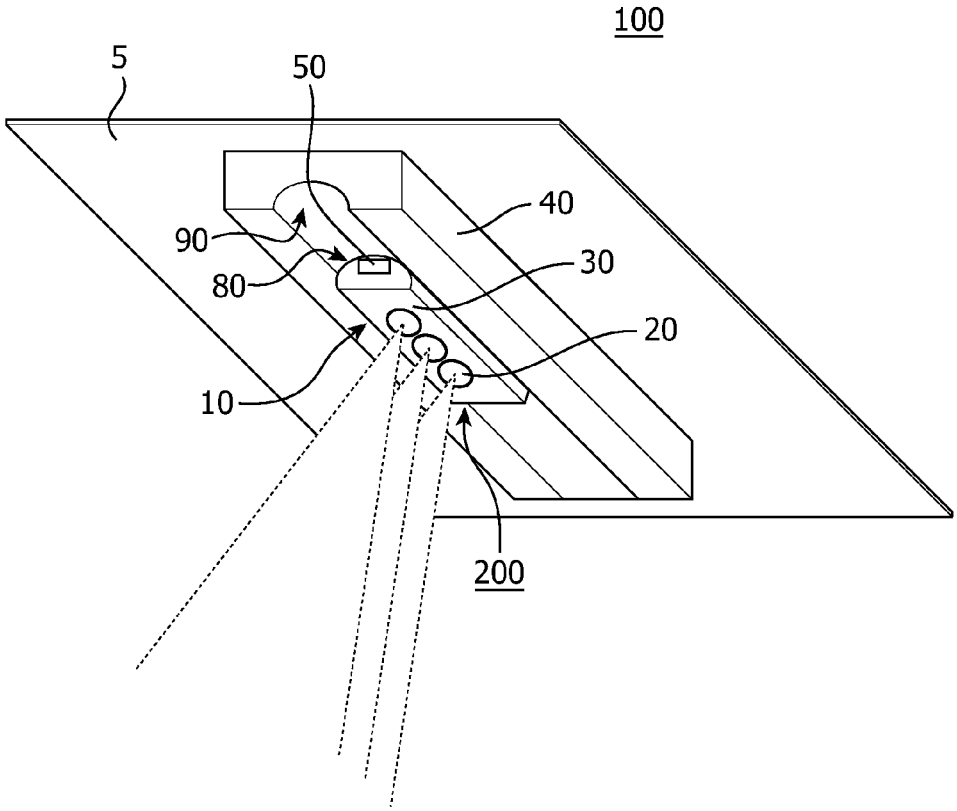
FIG. 1 shows a plan-view of an illumination system comprising a light source including a directable magnetic mount comprising a light emitter arranged in a base constituted by a heat sink.

FIG. 1 shows a plan-view of an illumination system 100 comprising a light source 200 including a directable magnetic mount 10 comprising a light emitter 20 arranged in a base 40 constituted by a heat sink 40. The base 40 is connected to a surface 5 which may, for example, be a wall 5, a ceiling 5, or any other surface 5 against which the illumination system 100 may be connected. In the embodiment shown in FIG. 1 part of the outer wall 90 of the heat sink 40 comprises a substantially cylindrical indentation 90. The light source 200 comprises interface means 30 partially having a shape of a cylinder having substantially the same radius as the cylindrical indentation 90 of the heat sink 40. Furthermore, the interface means 30 comprises material capable of conducting thermal energy away from the light emitter 20. Due to the fact that the at least part of the outer wall 80 of the interface means 30 comprises the cylindrical shape matching the cylindrical indentation 90 of the heat sink 40, the light source may be rotated around the central axis of the cylindrical indentation 90 and as such alter the orientation of the interface means 30 with respect to the heat sink 40 and/or base 40. Because the light emitter 20 is arranged at a truncated edge of the interface means 30, the emission direction of the light emitter 20 is also altered when rotating the interface means 30. A further effect of the close match between the at least part of the outer wall 80 of the interface means and the outer wall 90 of the heat sink 40 is that this close match also allows transfer of heat from the interface means 30 to the heat sink 40. Also when rotating the interface means 30 with respect to the heat sink 40, the shapes remain matching and therefore the possible transfer of heat from the interface means 30 to the heat sink 40 at the plurality of orientations of the interface means 30 relative to the heat sink 40 remains. As such, no additional cooling mechanisms are required for the light source 200 as the heat can efficiently be transferred to the heat sink 40 of the base 40. The current construction thus results in a relatively small light source 200 which may be repositioned relatively easily along the base 40 and in which the emission direction of the light emitted by the light emitter 20 may also be altered relatively easily.

To connect the light source 200 to the base 40 the directable magnetic mount 10 comprises a magnetic connector 50 which magnetically connects to the base 40. In the embodiment shown in FIG. 1 the base 40 is, for example, a metal rail 40 which has sufficient surface (In general, heat sinking is done by surface area rather than mass. Mass only delays temperature increase, area removes heat to the surroundings, which is a continuous process.) to also act as the heat sink 40 via which the interface means 30 can cool the light emitter 20. When the base 40 or heat sink 40 comprises magnetically susceptible material (not indicated), the magnetic connector 50 may be positioned at any location along the heat sink 40. Alternatively, predefined locations of the base 40 and/or heat sink 40 may locally comprise magnetically susceptible material (not shown). In such an arrangement, the directable magnetic mount 10 can only be positioned at or near the locally arranged magnetically susceptible material. The magnetic connector 50 also ensures thermal interconnection between the interface means 30 and the heat sink 40. Typically, to obtain a good thermal conduction between the interface means 30 and the heat sink 40, not only part of the surfaces 80, 90 of the interface means 30 and the heat sink 40 should match in shape to allow good contact, but the contact between these two matching surfaces 80, 90 should also be ensured, preferably urged against each other at a predefined force. Due to the presence of the magnetic connector 50, the light source 200 is connected to the base 40 and the interface means 30 of the light source 200 is urged against the heat sink 40 at a predefined force. This ensures a predefined thermal conduction between the interface means 30 and the heat sink 40.

In a preferred embodiment, the base 40 comprises electrical supply contacts 75 (see FIG. 5A) and the directable magnetic mount 10 comprises a plurality of electrical connectors 70 for providing power to the light emitter 20. As the orientation of the interface means 30 may be altered with respect to the base 40/heat sink 40, the polarity of the power provided to two of the plurality of electrical connectors 70 of the directable magnetic mount may vary. For this reason, the directable magnetic mount 10 may comprise an electronic circuit 300 (not shown in FIG. 1, but a possible circuit is illustrated in FIG. 5B for adapting the polarity of the electrical connectors 70 to match the required polarity of the provided power to the light emitter 20. To allow optimum flexibility, the electrical supply contacts 75 are constituted of fixed tracks 75 (see FIG. 5A) and the directable magnetic mount comprises a plurality of electrical connectors 70 distributed in a row of electrical connectors 70 arranged in a direction parallel to the direction of change of orientation of the interface means 30 with respect to the heat sink 40. Changing the orientation of the interface means 30 may relocate the electrical connectors 70 with respect to the electrical supply contacts 75 in such a way that the polarity of the power provided via the electrical connectors 70 is changed, which is corrected, for example, via the electrical circuit 300. This electrical circuit 300 is, of course, only required when the power provided to the light source 200 is a DC-power. In case an AC-power is provided, the electrical circuit 300 is not required.

The light source 200 may further comprise feedback electronics (not shown) including sensors (not shown) which may switch off and/or dim the light emitter 20 when the light emitter 20 becomes too hot. These feedback electronics are already known in the art and may also be applied here. As the operational life of the light emitter 20 often depends on the cooling or quality of cooling of the light emitter 20, reduction of the cooling or of the quality of cooling may increase the temperature of the light emitter 20 such that the operational life of the light emitter 20 is reduced. In such a case, the light emitter 20 may be switched off via the feedback electronics. The reduction of the cooling may be caused by dirt or dust arranged between the interface means 30 and the heat sink 40, substantially reducing the thermal conduction of heat from the light emitter 20 via the interface means 30 to the heat sink 40.

In a preferred embodiment, the magnetic connector 50 is located outside the thermal conductive path (not indicated) of the interface means 30. The thermal conductive path is the path in the interface means 30 via which a major part, for example 80% of the conducted heat is conducted to the heat sink 40. The magnetic connector 50 may comprise a 'permanent' magnet 50 of which the magnetic properties may change due to temperature influences. So by arranging the magnetic connector 50 outside the thermal conductive path, changes in the magnetic characteristics of the magnetic connector 50 may be reduced and/or avoided ensuring a good thermal contact between the interface means 30 and the heat sink 40. Alternatively, the magnetic connector 50 may be thermally insulated (not shown) from the interface means 30 to limit a temperature increase of the magnetic connector 50.

Figure 2A:
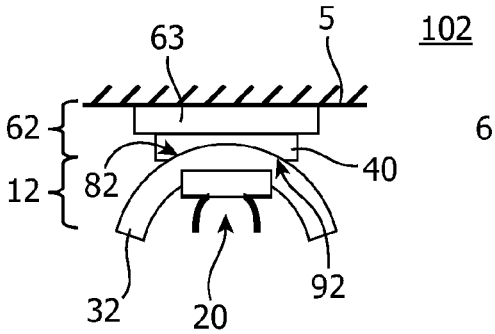
FIGS. 2A and 2B show schematic cross-sectional views of a further embodiment of an illumination system in which the interface means is oriented with respect to the heat sink in two different orientations.
Figure 2B:
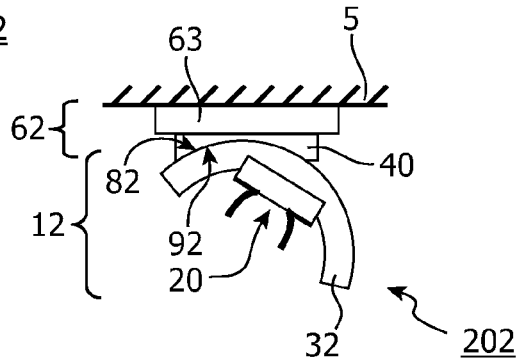

FIGS. 2A and 2B show schematic cross-sectional views of a further embodiment of an illumination system 102 in which the interface means 32 is oriented with respect to the heat sink 40 in two different orientations. The base 62 is constituted of the heat sink 40 and a substrate 63. The outer wall 92 of the heat sink 40 has the same shape as the outer wall 82 of the interface means 32. The directable magnetic mount 12 may be rotated to redirect the light emitter 20 to alter the emission direction of the light emitter 20. In FIGS. 2A and 2B the magnetic connector 50, the electrical connectors 70 and the electrical supply contacts 75 are omitted for clarity reasons. The base 62 may be a rail 62 attached to a surface 5 or may be a fixture having a different shape, for example, square or round, as long as the heat sink 40 has sufficient heat capacity to cool the light emitter 20 sufficiently such that the light emitter 20 can be safely operated.

The embodiment shown in FIGS. 2A and 2B may be a partially cylindrical light source 202 or a partially spherical light source 202. When the embodiment of FIGS. 2A and 2B represents a partial cylindrical light source 202, the light emitter 20 can substantially only be redirected in one dimension by rotating the cylindrical light source 202 around a central axis (not shown) of the cylindrical shape of the outer wall 82 of the interface means 32. When the embodiment of FIGS. 2A and 2B represents a partial spherical light source 202, the light emitter 20 can be redirected in two dimensions by rotating the spherical light source 202 around the center point (not shown) of the spherical shape of the outer wall 82 of the interface means 32.

Figure 2C:
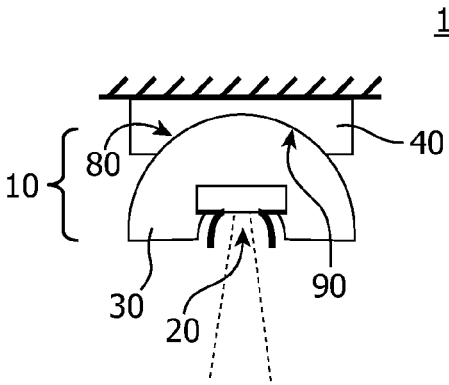
FIGS. 2C and 2D show schematic cross-sectional views of the illumination system as shown in FIG. 1, FIGS. 3A to 3D show a plurality of schematic cross-sectional views of illumination systems according to the invention.
Figure 2D:
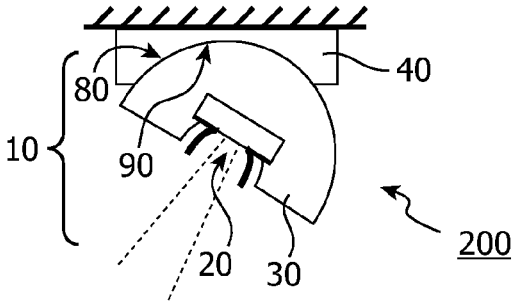

FIGS. 2C and 2D show schematic cross-sectional views of the illumination system 100 as shown in FIG. 1. A major difference with the embodiment shown in FIGS. 2A and 2B is that the interface means 30 has a substantially larger volume compared to the embodiment shown in FIGS. 2A and 2B. As such, the interface means 30 may also be partially used as heat sink. Again, different orientations are shown and in each orientation the matching shape of the outer wall 90 of the heat sink 40 and the outer wall 80 of the interface means 30 ensure that good thermal conductivity from the light emitter 20 to the heat sink 40 is maintained. The cross sections shown in FIGS. 2C and 2D may represent a substantially cylindrical light source 200 as shown in FIG. 1. Alternatively, the cross sections shown in FIGS. 2C and 2D may also represent a substantially spherical light source 200 which may allow a plurality of orientations of the interface means 30 with respect to the heat sink 40 in two dimensions.

FIGS. 3A to 3D show a plurality of schematic cross-sectional views of illumination systems 202, 204, 206, 208 according to the invention.

Figure 3A:
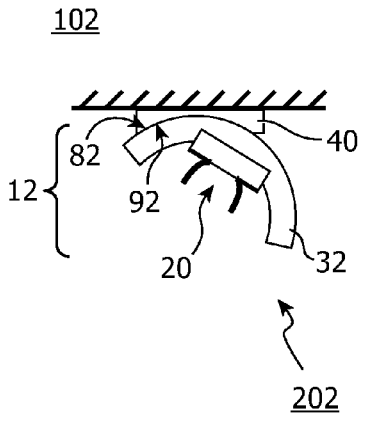

The illumination system 102 shown in FIG. 3A is a copy of the illumination system shown in FIGS. 2A and 2B and has been added for reference purposes.

Figure 3B:
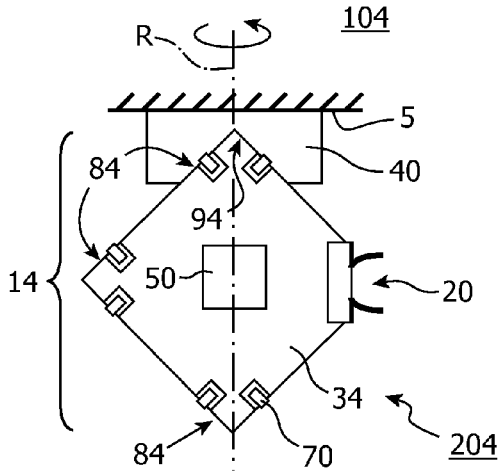

The illumination system 104 shown in FIG. 3B comprises a heat sink 40 having an outer wall 94 having a substantially triangular shape. The light source 204 shown in FIG. 3B comprises a directable magnetic mount 14 comprising an interface means 34 having a square shape and having at least part of the outer wall 84 of the interface means 34 which matches the outer wall 94 of the heat sink 40. Three out of four corners of the square shaped interface means 34 have an outer wall 84 which matches the outer wall 94 of the heat sink 40 and as such, the orientation of the interface means 34 with respect to the heat sink 40 can be altered, thus altering the emission direction of the light emitter 20. In the embodiment shown in FIG. 3B also electrical connectors 70 are indicated together with the magnetic connector 50. In the embodiment shown in FIG. 3B the light emitter 20 is arranged at one of the corners of the square shaped interface means 34. Alternatively (not shown), the light emitter 20 may be arranged at one of the sides of the square shaped interface means, between two subsequent corners. The interface means 34 shown in FIG. 3B may have a shape of a quadratic prism 34 or may have a cubic shape 34. The quadratic prism 34 allows a changing of orientation around an axis parallel to the central axis of the quadratic prism 34. The cubic shape 34 allows also a changing of orientation around a rotational axis R (indicated with a dash-dotted line) perpendicular to the surface 5.

Figure 3C:
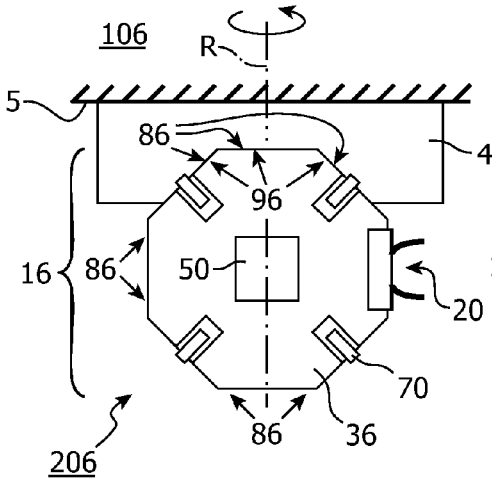

The illumination system 106 shown in FIG. 3C comprises a heat sink 40 having an outer wall 96 having a substantially polygonal shape. The light source 206 shown in FIG. 3C comprises a directable magnetic mount 16 comprising an interface means 36 having an octagonal shape 36 and having at least part of the outer wall 86 of the interface means 36 which matches the outer wall 96 of the heat sink 40. Three out of four sides of the octagonal shaped interface means 36 have an outer wall 86 which matches the outer wall 96 of the heat sink 40 and as such, the orientation of the interface means 36 with respect to the heat sink 40 can be altered, thus altering the emission direction of the light emitter 20. Again, electrical connectors 70 are indicated together with the magnetic connector 50. In the embodiment shown in FIG. 3C the rotation of the interface means 36 may be done over 90 degrees rotation steps to ensure that the electrical connectors 70 may be in contact with electrical supply contacts 75 at the base 40. However, by having an electrical connector 70 at every free side of the octagonal shaped interface means 36, a re-orientation of the light emitter 20 over a rotation angle of 45 degrees may be possible. The interface means 36 shown in FIG. 3C may have an elongated shape of an octagonal prism 36 or may be a regular polyhedron, e.g. octahedron (body consisting of 8 triangles, dodecahedron (body consisting of 12 pentagons) or icosahedrons (body consisting of 20 triangles) 36. The octagonal cubic shape 36 would also allow a changing of orientation around the rotational axis R (indicated with the dash-dotted line) perpendicular to the surface 5.

Figure 3D:
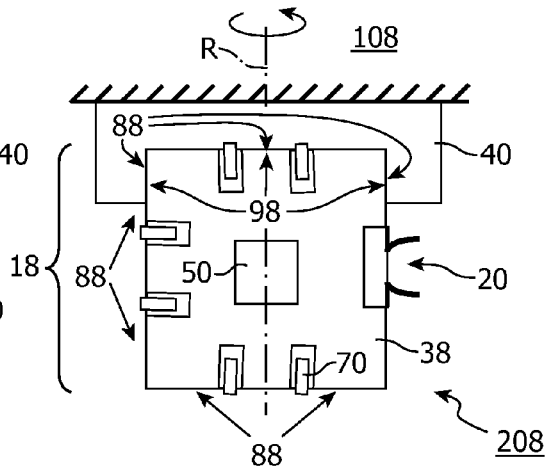

The illumination system 108 shown in FIG. 3D comprises a heat sink 40 having an outer wall 98 having a substantially polygonal shape. The light source 208 shown in FIG. 3D comprises a directable magnetic mount 18 comprising an interface means 38 again having a square shape 38 and having at least part of the outer wall 88 of the interface means 38 which matches the outer wall 98 of the heat sink 40. Three out of four sides of the square shaped interface means 38 have an outer wall 88 which matches the outer wall 98 of the heat sink 40 and as such, the orientation of the interface means 38 with respect to the heat sink 40 can be altered, thus altering the emission direction of the light emitter 20. The interface means 38 would also allow a changing of orientation around the rotational axis R (indicated with the dash-dotted line) perpendicular to the surface 5.

Figure 4A:
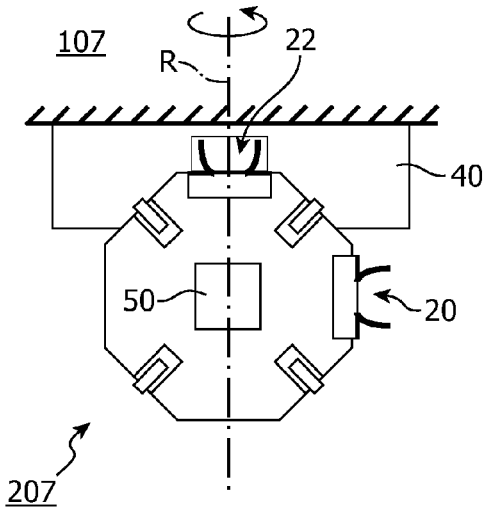
FIGS. 4A and 4B show the cross-sectional views of the illumination system of FIG. 3C which now comprises two light emitters.
Figure 4B:
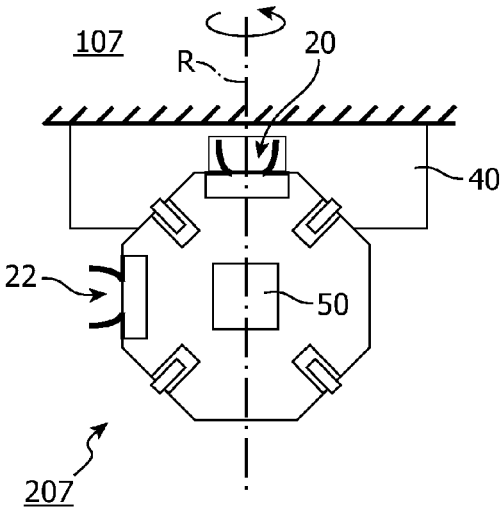

FIGS. 4A and 4B show the cross-sectional views of the illumination system 107 of FIG. 3C which now comprises two light emitters 20, 22. For clarity reasons, several reference numbers which are indicated in FIG. 3C have been left out in the FIGS. 4A and 4B. The orientation of the light source 207 may be altered with respect to the heat sink 40 via rotation of the light source 207 around an axis arranged substantially parallel to the heat sink 40 being parallel to the surface 5 or around the rotational axis R (indicated with a dash-dotted line). In the heat sink 40 an indentation is provided in which, for example, one of the two light emitters 20, 22 may fit such that the light emitter is not visible and/or usable. The further light emitter 22 may, for example, emit light of a different color, intensity or having a different beam shape compared to the light emitter 20. Alternatively, the further light emitter 22 is identical to the light emitter 20 and a rotation of the light source 207 may enable both the light emitter 20 and the further light emitter 22 to contribute to the light emitted from the illumination system 107. The two schematic cross-sectional views of FIGS. 4A and 4B illustrate only two of the many different orientation directions of the light source 207 relative to the heat sink 40.

Figure 4C:
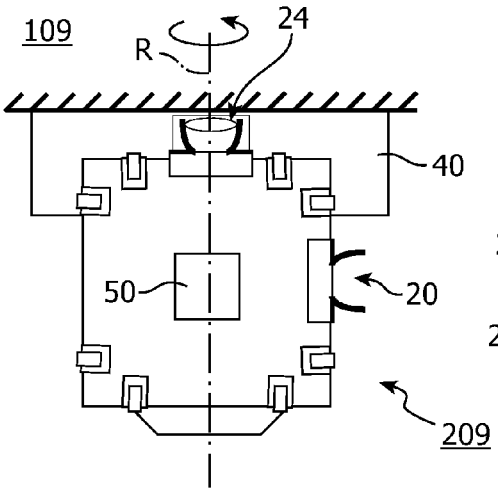
FIGS. 4C and 4D show a cross-sectional view of a slightly modified illumination system of FIG. 3D now also comprises two light emitters, one of the two light emitters having a beam-shaping lens.
Figure 4D:
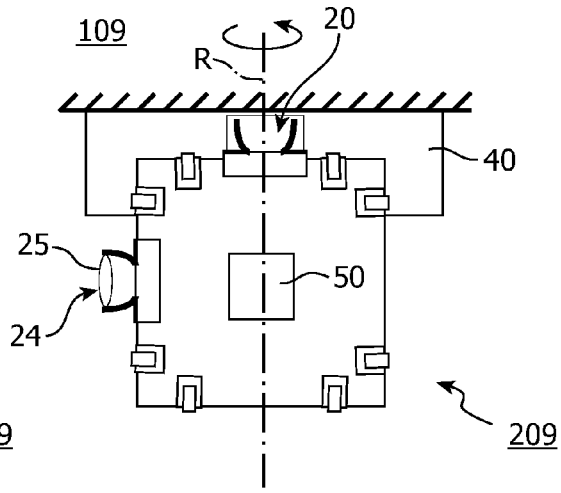

FIGS. 4C and 4D show cross-sectional views of a slightly modified illumination system 109 of FIG. 3D in which the distance between the electrical connectors 70 is somewhat changed and which now also comprises two light emitters 20, 24, one of the two light emitters 24 having a beam-shaping lens 25. The orientation of the light source 209 may be altered with respect to the heat sink 40 via rotation of the light source 209 around an axis arranged substantially parallel to the heat sink 40 being parallel to the surface 5 or around the rotational axis R (indicated with a dash-dotted line). The beam-shaping lens 25 may, for example, cause the emission profile of the light emitted by the further light emitter 24 to be different compared to the emission profile of the light emitter 20. As such, the change of orientation of the light source 209 may allow a user to alter the emission profile by changing the intensity variation emitted by the further light emitter 24. The beam-shaping lens 25 may alternatively comprise a filter 25 which is used to alter the color of the light emitted by the light emitter 24. In an alternative embodiment, an orientation of the light source 209 with respect to the heat sink 40 may be chosen such that both light emitters 20, 24 contribute to the emission of light from the illumination system 109. In such a case, different intensities, beam shapes and/or colors of light may be emitted in different directions from the illumination system 109.

Figure 5A:
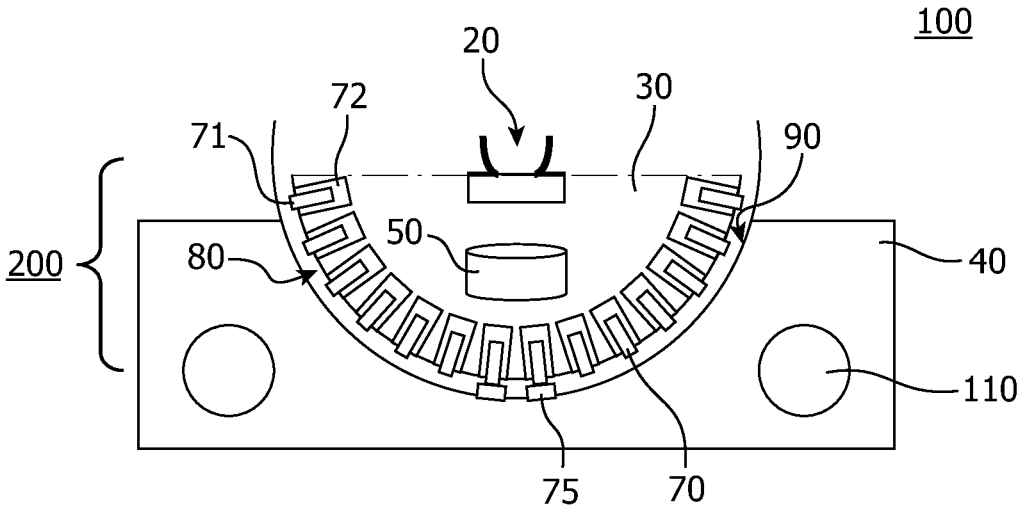
FIG. 5A shows a detailed cross-sectional view of the illumination system of FIG. 1 in which the electrical connectors and the electrical supply contacts are shown.
Figure 5B:
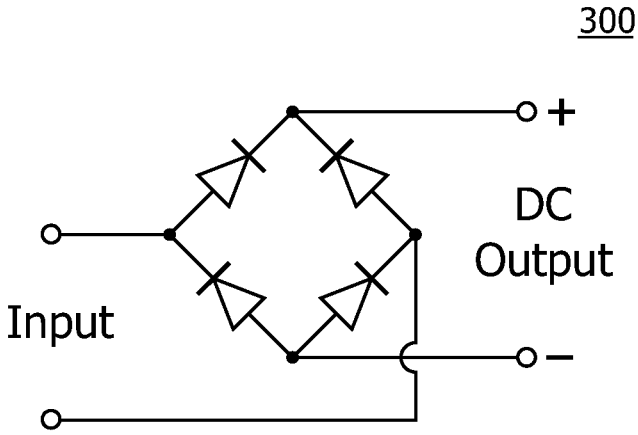
FIG. 5B shows an example of an electronic circuit for adapting the polarity of the applied power supply to match the polarity required by the light emitter.

FIG. 5A shows a detailed cross-sectional view of the illumination system 100 of FIG. 1 in which the electrical connectors 70 and the electrical supply contacts 75 are shown in more detail. Generally only two electrical supply contacts 75 are required both for DC power and for AC power. To enable the interface means 30 to be able to change the orientation of the light emitter 20 with respect to the heat sink 40, a plurality of electrical connectors 70 are applied. Of course, alternatively, a plurality of electrical supply contacts 75 may be arranged such that the at least two electrical connectors 70 are always connected to at least two electrical supply contacts 75 to ensure power to the light emitter 20. However, this typically requires more conductive tracks and typically is avoided as a solution as it typically is more expensive. The electrical connectors 70 are indicated as movable pins 71 which are arranged in slots 72 and which are generally urged outwards out of the slots 72, for example, via springs (not shown). These springs ensure that the movable pins 71 are securely pressed against the electrical supply contacts 75 to ensure flawless power supply. Of course, the springs for urging out the movable pins 71 should not be stronger than the force with which the interface means 30 is urged against the heat sink 40 via the magnetic connector 50, because then the springs would prevent thorough thermal contact between the interface means 30 and the heat sink 40, thus endangering the light emitter 20 to become overheated.

A further detail of FIG. 5A is that the heat sink 40 comprises ducts 110 for allowing cooling fluids (not shown) to pass through the heat sink 40. These ducts 110 may comprise a cooling liquid or may, for example, be open to allow air to pass through and as such increase the surface of the heat sink 40 to the environment, allowing the heat sink 40 to be cooled by convection of ambient air through the ducts 110.

FIG. 5B shows an example of an electronic circuit 300 for adapting the polarity of the applied power supply to match the polarity required by the light emitter 20. The electronic circuit 300 is a well-known bridge rectifier which may be arranged between a plurality of electronic connectors 70 and the pair of contacts of the light emitter 20. A first input port of the bridge rectifier 300 may, for example, be connected to the odd-numbered electrical connectors 70 (being the first, third, fifth, . . . etc) in a row of electrical connectors 70. A second input port of the bridge rectifier 300 may, for example, be connected to the even-numbered electrical connectors 70 (being the second, fourth, sixth, . . . etc) in the row of electrical connectors 70. The output of the bridge rectifier 300 always comprises the same polarity which may be suitably connected to the light emitter 20.

Figure 6A:
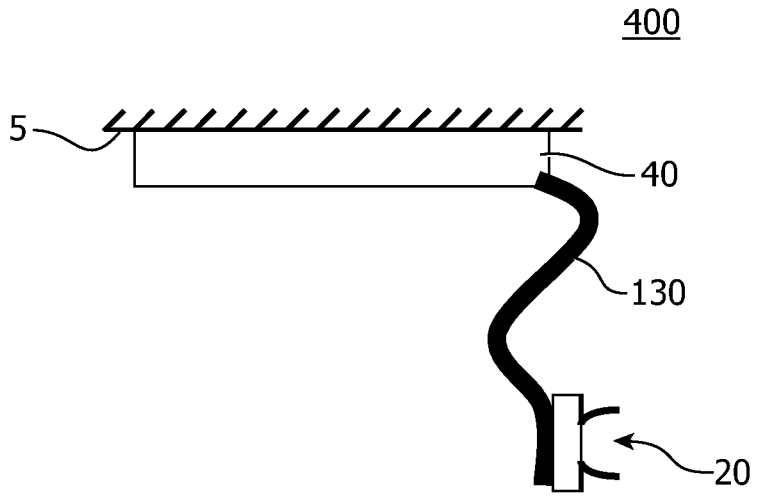
FIGS. 6A and 6B show alternative embodiments of illumination systems.
Figure 6B:
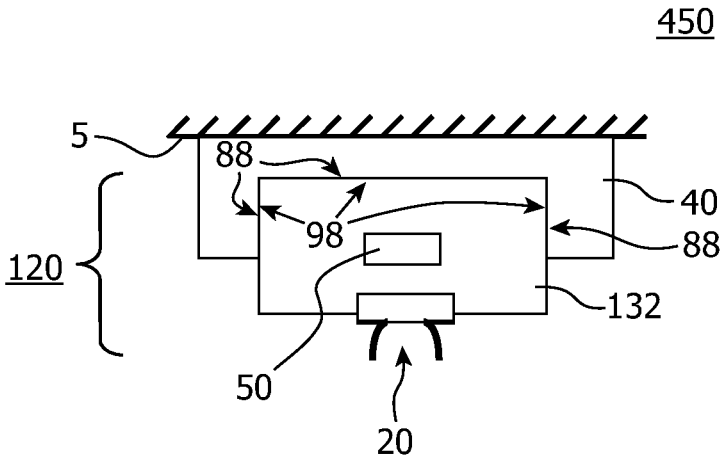

FIGS. 6A and 6B show alternative embodiments of illumination systems 400, 450 which use relatively large heat sinks 40 for cooling the light emitter 20, and comprising an interface means 130, 132 to conduct thermal energy away from the light emitter 20 to the heat sink 40.

In the embodiment shown in FIG. 6A, a large heat sink 40 is arranged, for example, at or near a surface 5 which may be a wall 5, ceiling 5, or any other surface 5. The light emitter 20 is connected to the interface means 130 which, for example, is a deformable duct 130 made of material able to conduct thermal energy well, for example, a metal. The heat conduction of the deformable duct 130 is increased if it has a large cross section. Since it has to be bendable, the best embodiment is probably a wide and thin metal plate 130. By directly connecting the light emitter 20 to the interface means 130, the light emitter 20 may conduct its thermal energy away from the light emitter 20 via the interface means 130 to the heat sink 40. Because the interface means 130 is constituted of a deformable duct, the orientation of the light emitter with respect to the heat sink 40 can be done while maintaining a good conductivity of the thermal energy towards the heat sink 40. Power may be supplied via power conducting tracks (not shown) on, through or at the deformable duct 130. As such, an elegant illumination system 400 may be obtained in which the direction of light emission of the light emitter 20 may be altered while the light emitter 20 may remain relatively small. Especially when using LEDs as light emitter 20, the cooling requirements for high power LEDs are relatively strong and typically require cooling fins to be present at the light emitter 20 limiting design options of the light emitter 20 and the option to make the light emitter 20 small.

In the embodiment shown in FIG. 6B, an illumination system 450 is shown having a relatively large heat sink 40 which is arranged, for example, at or near a surface 5 which may be a wall 5, ceiling 5, or any other surface 5. The light emitter 20 is connected to the interface means 132 which, for example, has a cubic shape. The heat sink 40 may be a track along which the interface means 132 may be repositioned at will and which may be connected to the heat sink 40 via a magnetic connector 50, clamping means (not shown) or other fastening means as long as it results in a good thermal contact for conducting thermal energy via the interface means 132 away from the light emitter 20. Due to the presence of a relatively large heat sink 40, the light source 120, being the light emitter 20 together with the interface means 132, may be relatively small. A characteristic of the current embodiment is that the projection of the interface means 132 is equal or smaller compared to the projection of the heat sink 40 acting as a rail 40. In the known "LED Magnetic Track Undercabinet Fixture" of the manufacturer "Lightolier"® (see their web site www.lightolier.com) the track is relatively small compared to the light source and additional cooling fins are required to cool the light emitter. In the current embodiment of FIG. 6B, the heat sink 40 is designed to have sufficient capacity to absorb the surplus of thermal energy of the light emitter 20 to ensure good operation of the light emitter without having to locally add additional cooling requirements such as cooling fins or other. Using a magnetic connector 50, a relatively simple repositioning is possible of the interface means 132 of the light source 120 along the heat sink 40 while allowing the dimensions of the light source 120 to remain relatively small.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. Directable magnetic mount for a light emitter requiring cooling, the directable magnetic mount comprising:

interface means configured for conducting thermal energy away from the light emitter to a heat sink, and a magnetic connector including a magnet that is configured for magnetically connecting the directable magnetic mount to a base comprising the heat sink, the magnetic connector being configured for thermally interconnecting the interface means and the heat sink, the interface means being configured for being thermally connected to the heat sink in a plurality of orientations of the interface means with respect to the heat sink such that said light emitter is operable in each of said orientations, wherein the magnet is outside a primary thermally conductive path by which the thermal energy is conducted away from the light emitter to the heat sink.

2. Directable magnetic mount as claimed in claim 1, wherein at least a part of an outer wall of the interface means comprises a first shape configured for being thermally connected to a part of an outer wall of a heat sink having a second shape matching the first shape.

3. Directable magnetic mount as claimed in claim 1, wherein the plurality of orientations of the interface means generate different emission characteristics of light emitted from the directable magnetic mount, the different emission characteristics comprising at least one of:

an emission direction of the light emitted from the directable magnetic mount, a shape of a bundle of light emitted from the directable magnetic mount, a color of the light emitted from the directable magnetic mount, an intensity and/or an intensity distribution of the light emitted from the directable magnetic mount, or a number of light emitters emitting light from the directable magnetic mount comprising a plurality of light emitters.

4. Directable magnetic mount as claimed in claim 1 further comprising:

a receiving portion configured to receive the light emitter, wherein the magnetic connector is arranged outside the primary thermal conductive path in the interface means between the receiving portion and the heat sink of said base, or wherein the magnetic connector is thermally insulated from the interface means.

5. Directable magnetic mount as claimed in claim 1, wherein the directable magnetic mount further comprises a plurality of electrical connectors configured for being connected, in operation, to electrical supply contacts at the base for providing at least one of power or control information to the light emitter.

6. Directable magnetic mount as claimed in claim 5, wherein the electrical connectors are arranged at the interface means, and wherein the plurality of electrical connectors comprise more than two electrical connectors, the plurality of electrical connectors being distributed across the interface means for connecting at least two electrical connectors of the plurality of electrical connectors to the electrical supply contacts at the different orientations of the interface means, and wherein each electrical connector of the plurality of electrical connectors is configured to conduct an electrical current from or to at least one of said electrical supply contacts.

7. Directable magnetic mount as claimed in claim 5, wherein the directable magnetic mount further comprises an electronic circuit for adapting the polarity of electrical connectors of the plurality of electrical connectors connected to match the required polarity of the light source.

8. Directable magnetic mount as claimed in claim 2, wherein the outer wall of the interface means and the first shape comprise:

a curved shape and a part of the curved shape, respectively, or a cylindrical shape and a part of the cylindrical shape, respectively, or a partial spherical shape and a part of the partial spherical shape, respectively, or a polygon and a corner of the polygon, respectively, or a polygon and a plurality of corners of the polygon, respectively.

9. A light source comprising a light emitter thermally connected to the directable magnetic mount according to claim 1.

10. A base for a directable magnetic mount according to claim 1, comprising:

a heat sink for conducting thermal energy away from the interface means connected to the light emitter, and magnetically susceptible material distributed in the base for magnetically connecting the directable magnetic mount to the base and for thermally interconnecting the interface means and the heat sink, wherein the magnetically susceptible material is distributed such that the directable magnetic mount is magnetically connected to the base only when electrical connectors of said directable magnetic mount and electrical connectors of said base are electrically coupled, the heat sink being configured for being thermally connected to the interface means in a plurality of orientations of the interface means with respect to the heat sink.

11. A base as claimed in claim 10, wherein the electrical connectors of the base comprises electrical supply contacts for providing power to the light emitter via at least two of the electrical connectors of the directable magnetic mount.

12. A base as claimed in claim 11, wherein the base comprises a distribution of magnetically susceptible material for connecting the directable magnetic mount via the magnetic connector at a plurality of locations with respect to the heat sink while connecting at least two electrical connectors of the plurality of electrical connectors to the electrical supply contacts in different emission directions of the light emitter.

13. A base as claimed in claim 10, wherein the base defines a plurality of ducts.

14. A base as claimed in claim 10, wherein a part of an outer wall of the heat sink comprises a second shape configured for being thermally connected to at least a part of an outer wall of the interface means having a first shape matching the second shape, and wherein the second shape comprises:

a curved shape, or a cylindrical shape, or a partially spherical shape, or a triangular shape, or a polygon.

15. A base as claimed in claim 10, wherein the magnetically susceptible material distributed in the base is magnetized by the magnet in the directable magnetic mount for magnetically connecting the directable magnetic mount to the base.

* * * * *